US006827416B2

(12) United States Patent
Matsumoto et al.

(10) Patent No.: US 6,827,416 B2
(45) Date of Patent: Dec. 7, 2004

(54) LIQUID DISCHARGE HEAD, LIQUID DISCHARGE APPARATUS, VALVE PROTECTION METHOD OF THE SAME LIQUID DISCHARGE HEAD AND MAINTENANCE SYSTEM

(75) Inventors: Nobuyuki Matsumoto, Tokyo (JP); Hiroyuki Ishinaga, Tokyo (JP); Yoshinori Misumi, Tokyo (JP); Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/944,137

(22) Filed: Sep. 4, 2001

(65) Prior Publication Data

US 2002/0027578 A1 Mar. 7, 2002

(30) Foreign Application Priority Data

Sep. 4, 2000 (JP) ..... 2000-267846

(51) Int. Cl.[7] ..... B41J 29/38
(52) U.S. Cl. ..... 347/17; 347/14; 347/65
(58) Field of Search ..... 347/14, 65, 17, 347/67

(56) References Cited

U.S. PATENT DOCUMENTS

| | | | | |
|---|---|---|---|---|
| 4,550,327 A | * | 10/1985 | Miyakawa | 347/67 |
| 4,723,129 A | | 2/1988 | Endo et al. | 346/1.1 |
| 5,886,713 A | * | 3/1999 | Okada et al. | 347/14 |
| 5,992,984 A | * | 11/1999 | Imanaka et al. | 347/65 |
| 6,270,200 B1 | | 8/2001 | Ishinaga et al. | 347/65 |
| 6,293,656 B1 | | 9/2001 | Okazaki et al. | 347/65 |

FOREIGN PATENT DOCUMENTS

| | | | |
|---|---|---|---|
| EP | 0569201 A1 | * | 11/1993 |
| EP | 0834402 | | 4/1998 |
| EP | 0920999 A2 | * | 6/1999 |
| JP | 9-201966 | | 8/1997 |
| JP | 10-109430 | | 4/1998 |

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

To provide a liquid discharge head, a liquid discharge apparatus, a valve protection method of the liquid discharge head, and a maintenance device.

The liquid discharge apparatus provided with: a discharge port for discharging liquid, a liquid flow path communicating with the discharge port having a bubble generating region for generating bubble, a discharge energy generating element for generating thermal energy for generating the bubble in the liquid inside the bubble generating region, and a liquid discharge head facing the discharge energy generating element spaced apart from the discharge energy generating element having a movable member in which an end portion at an upstream side in a flow direction of the liquid inside the liquid flow path is fixed and a downstream end thereof is a free end, in which ink is discharged from the liquid discharge head and a recording is performed by adhering the liquid on a medium to be recorded, includes: a unit for detecting an ink supply state inside the liquid flow path, and a unit for controlling or stopping the driving to the discharge energy generating element when a judgment is made that the ink is not normally supplied based on the detection result of the ink supply state inside the liquid flow path.

4 Claims, 9 Drawing Sheets

LIQUID DISCHARGE HEAD, LIQUID DISCHARGE APPARATUS, VALVE PROTECTION METHOD OF THE SAME LIQUID DISCHARGE HEAD AND MAINTENANCE SYSTEM

BACKGROUND OF THE INVENTION

1. Field of the Invention

The present invention relates to a liquid discharge head and a liquid discharge apparatus used for a printer and a video printer as an output terminal of a copying machine, a facsimile machine, a word processor, a host computer or the like. Specifically, the present invention relates to a system for a maintenance of an electro-thermal conversion element for generating bubble forming thermal energy which is utilized for discharge liquid and a liquid discharge head having a movable member which is displaced accompanied by the formation of the bubble and a liquid discharge recording apparatus mounted with the liquid discharge head and the movable member.

2. Related Background Art

Conventionally, there has been known an ink jet recording method, the so-called bubble jet recording method, wherein, by giving ink energy such as heat, the ink is allowed to produce a change of state accompanied by a rapid volume change and, by an action force resulting from this change of state of the ink, the ink is discharged from the ink discharge port, and is adhered onto a medium to be recorded so as to perform an image forming. In the recording apparatus using this bubble jet recording method, as disclosed in U.S. Pat. No. 4,723,129, there are usually arranged a discharge port for discharge the ink, an ink flow path communicating with this discharge port and an electro-energy conversion member as energy generating means for discharging the ink which is inside the ink flow path.

According to such a recording method, high quality images can be recorded at high speed with a low noise. At the same time, the head performing this recording has many excellent merits in that, because the discharge ports for discharging the ink are arranged in high density, not only recording images of high resolution but also color images can be easily acquired using a small-size device. For this reason, in recent years, this bubble jet recording method has come to be used for a number of business machines such as printers, recopying machines, facsimile machines and the like and, furthermore, even come to be used as far as in the field of an industrial system such as a textile printing apparatus or the like.

As such a bubble jet technique has become more widespread in various fields of products, in recent years, the following various types of demand for further developments have been on the rise.

For example, regarding the request for improvement of energy efficiency, optimization of a heat generating element by adjusting the thickness of the protection layer of the heat generating element can be enumerated. This method is effective in terms of improving propagation efficiency of the generated heat to the liquid.

Further, in order to obtain high quality image, there has been proposed a driving condition for giving an liquid discharge method or the like having high ink discharge speed for performing an excellent ink discharge based on a stable bubble generation or, with a view toward high-speed recording, there has also been proposed an improved shape of the liquid flow path for acquiring a liquid discharge head having high refill speed of the discharged liquid to the inside of the liquid flow path.

Furthermore, by returning to the basic principles of the liquid discharge, experimental studies have been made to provide a new liquid discharge method utilizing the bubble, a head used for that method or the like, and the liquid discharge method and the head used for that method, as disclosed in Japanese Patent Application Laid-Open No. 9-201966 specification, have been proposed.

Here, the conventional liquid discharge method and the head used for that method disclosed in Japanese Patent Application Laid-Open No. 9-201966 specification will be described with reference to FIGS. 8A to 8D and FIGS. 9 to 10. FIGS. 8A to 8D are views explaining a discharge principle in the conventional liquid discharge head, and each of FIGS. 8A to 8D is a cross-sectional view along the liquid flow path direction. FIG. 9 is a partially broken oblique view of the liquid discharge head as shown in FIGS. 8A to 8D. FIG. 10 is a cross-sectional view of a modified example of the liquid discharge head as shown in FIGS. 8A to 8D. The liquid discharge heads shown in FIGS. 8A to 8D and FIG. 10 have the most basic constitutions which control the propagation and the direction of the pressure as well as the growth direction of the bubble based on the bubble at the time of discharge liquid and improve a discharge force and a discharge efficiency. In FIG. 9, reference symbol C denotes a center of the heat generating element region.

y As used herein, "upstream" and "downstream" have to do with the flow direction of the liquid from a supply source of the liquid to a discharge port through the upper direction of the bubble generating region or the constitutional direction of the liquid flow.

Further, what is meant by "downstream side" represents a discharge port side of the bubble which is taken as mainly directly acting on the discharge of the liquid droplet. To be more concrete, it means the downstream side regarding the above-described flow direction or the above-described constitutional direction against the center of the bubble, or the bubble to be generated in the region at the downstream side rather than the center of the heat generating element region. (Similarly, what is meant by "upstream side" regarding the bubble itself is an upstream side regarding the above-described flow direction or the constitutional direction against the center of the bubble, or the bubble to be generated in the region at the upstream side rather than the center of the heat generating element region). Further, what is meant by "comb teeth" is a form in which a supporting point of the movable member is a common member and the front of a free end of the movable member is open.

In the liquid discharge head as shown in FIGS. 8A to 8D, a heat generating element 502 for allowing thermal energy to act on the liquid as a discharge energy generating element for discharge the liquid is installed at an element substrate 501. On the element substrate 501, corresponding to the heat generating element 502, a liquid flow path 503 is arranged. The liquid flow path 503 communicates with a liquid discharge port 504 and also communicates with a common liquid chamber 505 for supplying the liquid to a plurality of liquid flow paths 503 and receives an amount of the liquid matching the liquid discharged from the discharge port 504.

On the portion corresponding to the liquid flow path 503 of the element substrate 501, a plate shaped movable member 506 having a flat surface portion opposing to the heat generating element 502 is installed in the shape of a cantilevered balcony. The movable member 506 is constituted by a material such as a metal or the like having an elasticity. One end of the movable member 506 is fixed to a pedestal 507 which is formed by patterning photosensitive resin or the like on the wall of the liquid flow path 503 and the element substrate 501. In this way, the movable member 506 is supported by the pedestal 507 so as to constitute a supporting point 508 of the movable member 506.

Further, by making the movable member 506 to be comb teeth shaped, the movable member 506 can be easily prepared and yet at a low cost, and an alignment of the movable member 506 to the pedestal 507 can also be easily made. The movable member 506 has the supporting point 508 at the upstream side of a large flow which flows to the side of the discharge port 504 through the upper direction of the movable member 506 from the common liquid chamber 505 by a discharge action of the liquid, and is arranged at a distance of about 15 $\mu$m apart from the heat generating element 502 in a position opposing to the heat generating element 502 such as to conceal the heat generating element 502 so that it has a free end 509 to this supporting point 508 in the downstream side. This space between the heat generating element 502 and the movable member 506 becomes a bubble generating region 510.

Next, the action of the liquid discharge head constituted as described above will be described with reference to FIGS. 8A to 8D.

First, in FIG. 8A, the insides of the bubble generating region 510 and the liquid pass 503 are filled with the ink.

Next, in FIG. 8B, by allowing the heat generating element 502 to produce heat, heat acts on the liquid of the bubble generating region 510 between the movable member 506 and the heating element 502 and that liquid is allowed to generate a bubble 511 based on a film boiling phenomenon as mentioned in U.S. Pat. No. 4,723,129. The pressure based on the generation of the bubble 511 and the bubble 511 preferentially acts upon the movable member 506, and the movable member 506 is largely displaced so as to open at the side of the discharge port 504 with the supporting point 508 as a center as shown in FIG. 8B, FIG. 8C or FIG. 9. Because of the propagation of the pressure based on the generation of the bubble 511 by the displacement or the displaced state of the movable member 506 and the top end of the bubble 511 having a width, a bubbling power of the bubble 511 is easily guided to the side of the discharge port 504 and fundamental improvement of a discharge efficiency and a discharge force of the liquid droplet or a discharge speed can be attempted.

As described above, the technique mentioned in Japanese Patent Application Laid-Open No. 9-201966 specification or the like is a technique where the physical relationship between the supporting point and the free end of the movable member is changed to the relationship in which the free end of the movable member is positioned at the discharge port side, that is, at the downstream side and where, by arranging the movable member to face the heat generating element or the bubble generating region, the bubble is actively controlled.

Each configuration of an element substrate 601 of the liquid discharge head, an heat generating element 602, a liquid flow path 603, a discharge port 604, a common liquid chamber 605 and a bubble generating region 609 as shown in FIG. 10 are each the same as in the liquid discharge head as described based on FIG. 8 and the description thereof will be omitted.

In the liquid discharge head as shown in FIG. 10, at one end of the movable member 606 which is formed in the shape of a cantilevered balcony, a stepped portion 606*a* is installed, and, on the element substrate 601, the movable member 606 is directly fixed. In this way, the movable member 606 is held on the element substrate 601 so as to constitute a supporting point 607 of the movable member 606, and a free end 608 is constituted in the downstream side to this supporting point 607.

As described above, by installing a pedestal at the fixed portion of the movable member or by installing the stepped portion to the fixed portion of the movable member, a gap of about 120 $\mu$m is constituted between the movable member and the heating portion, thereby sufficiently drawing out the effect of improving the liquid discharge efficiency by the movable member. Consequently, according to the liquid discharge head based on the discharge principle as described above, synergistic effects with the bubble generated and the movable member displaced by this bubble can be obtained, and the liquid in the vicinity of the discharge port can be effectively discharged, so that the discharge efficiency of the liquid is improved in contrast to the discharge method and the liquid discharge head of the conventional bubble jet system which does not use the movable member.

As described above, in the liquid discharge head having the movable member and the recording apparatus provided with the head, the present inventors in the process of seeking the effect obtainable from the mobility of the movable member (which is also referred to as "valve") to the highest possible level found that, in order to secure high longevity, high reliability or the like of the valve action, it is necessary to maintain a movable load of the valve, while attempting to protect the movable member and stabilize the liquid discharge system by estimation of the ambient air temperature of the valve, the detection thereof or the like.

That is, in the process of studying to provide the movable member itself with high level which exceeds the life of the electro-thermal conversion element, when discharge endurance/change of performance of the head were being observed, a change was developed in the discharge itself at a certain time, and a phenomenon occurred in which the stable discharge at high frequency driving which is one of the effects of the valve becomes unstable.

In spite of the rigid design of the valve being performed for optimizing not only the valve action but also the head efficiency, there have been found significant differences between the valve action in a state of being normally supplied with the ink inside the recording head and the valve action in a state of being not supplied with the ink, and its the valve life. Here, what is meant by the state of being not supplied with the ink is a non-discharge phenomenon (a state in which the ink is not normally discharged(ejected)) where, in the course of the continuous discharge by the recording head, the minute bubbles existing in the ink supply pass are mixed into a nozzle accompanied with the ink supply refill at a time of the continuous discharge, thereby causing the ink to run out partially at each nozzle, or a phenomenon where the minute bubbles gather in an ink liquid chamber at the rear of the nozzle or the bubbles grow into big bubbles by the temperature rise due to the driving of the heat generating element so that the bubbles are drawn into a number of nozzles accompanied by the ink supply refill at a time of the continuous discharge, thereby leading a number of nozzles to continuous non-discharge. The present inventors in the course of the experimental studies and observations found the following relationships between the action and the life of the valve member.

In the case where the ink does not exist at all inside the liquid flow path of the nozzle, when the driving of the heat generating element is performed, in spite of the fact that the valve member does not act, the life of the valve member is sometimes reduced. This is because, during the image data is being printed when the heat generating element falls into this state during continuous discharge, the heat generating element is continuously heated in a state of being unable to secure the so-called heat loss effect which is to take and exhaust the heat of the head when the ink is discharged and the temperature of the element substrate having the heat generating element and the valve member rapidly rises and attains high temperature which is not reachable in a state where the ink normally exists. Further, after this state continues for a while, when the ink, which is at ordinary temperature, is supplied into the nozzle, stress on the valve member resulting from instantaneous thermal shock, promotes the development of rigidity and material fatigue. Similarly, when ink is supplied at a high temperature which is not reachable in the ink's normal state, an excessive film boiling due to the state of high temperature is generated, which is different from the film boiling desired to be generated by a controlled pulse applied to achieve discharge, and, in particular, the valve member having a pedestal or the like at its fixed portion is instantaneously subjected to an unimaginable valve displacement, resulting in that physical stresses on the pedestal or the like.

This phenomenon shows a tendency toward the situation in which fatigue of the valve member in the absence of ink in creases with the shape where the displacement stress to the valve member by the valve mobility is larger, and, in the worst case, it was ascertained that the phenomenon also leads to fatigue defects due to the generation of cracks or the like in the movable member itself.

In this way, it was confirmed that, as the discharge in a state where the ink is not supplied to the inside of the recording head (hereinafter, referred to as "empty discharge" or "empty printing") is repeated many times, the fatigue of the valve portion develops its effect at an early stage; therefore, in order to avoid this problem, it was recognized that employment of the maintenance system for avoiding empty discharge and empty printing and thus limiting fatigue of the valve member to the smallest possible minimum is the most important problem in terms of achieving still more reliability and durability.

In order to realize this problem, irrespective of whether the recording head is in the midst of stand-by for printing or during printing, the state of the ink inside the recording head chip is detected, and, if the ink supply is not normal, for example, if the ink supply is in a defect state, the discharge signal is shut off in the early stage so as to prevent the empty discharge or printing defect, It was found that when the defect state of the ink supply can be estimated, forced deaeration of the bubble inside the recording head by suction means provided for the recording apparatus can prevent the empty discharge.

Accordingly, the present invention provides a movable valve protection method aimed at preventing the fatigue defects in the valve member due to repeated empty discharge as described above and securing high longevity or high reliability of not only the movable valve but also of the head; this may also be considered to be a movable value durability improvement method. Also provided are an ink jet head structure and an ink jet recording apparatus.

The present invention provides a system, where in order to control accumulation of the stresses in the displacement of the movable member and thermal shock stresses to the smallest possible minimum, by judging whether there has been a liquid supply failure, intrinsic characteristics of the movable member are secured, and by utilizing even anticipated and estimated level of a failure from the substantial detection of the liquid supply failure, a safety factor can be enhanced.

SUMMARY OF THE INVENTION

In order to attain the above-described object, the present invention provides a liquid discharge head including: a discharge port for discharge liquid; a liquid flow path communicating with the above-described discharge port having a bubble generating region for generating a bubble in the liquid inside said bubble generating region; a discharge energy generating element for generating thermal energy for generating the bubble in the liquid inside the above-described bubble generating region; and a movable member which faces the above-described discharge energy generating element spaced apart from the above-described discharge energy generation and in which an end portion at the upstream side in the flow direction of the liquid inside the above-described liquid flow path is fixed and a downstream end is a free end, in which the ink is discharged from the liquid discharge head and a recording is performed by adhering the above-described liquid on the medium to be recorded, and in which, based on means for detecting the ink supply state inside the above-described liquid flow path and the detection result of the ink supply state inside the above-described liquid flow path, if a judgment is made that the ink is in a state of being not normally supplied, means for controlling or stopping the driving to the above-described discharge energy generating element is provided.

Means for detecting the above-described ink supply state is considered to be temperature detection means for detecting a temperature rise per unit time inside the liquid flow path.

Further, the present invention includes a liquid discharge apparatus having a liquid discharge head such as the above-described and a driving signal supply means for supplying a driving signal for discharge the liquid from the liquid discharge head and, furthermore, a liquid discharge apparatus having a liquid discharge head such as the above-described, medium to be recorded conveyance means for conveying a medium to be recorded which receives the liquid discharged from the liquid discharge head. In these liquid discharge apparatuses, those performing the recording by discharge the ink from the above-described liquid discharge head by adhering the above-described ink on the medium to be recorded are preferable.

Furthermore, the present invention relates to a valve protection method of a liquid discharge head having a heat generating element inside a liquid flow path communicating with a discharge port and a movable plate for directing a bubble growing by a film boiling on said heat generating element to a side of said discharge port, in which an ink supply state inside said liquid flow path is detected and the driving to said heat generating element is controlled or stopped when a judgment is made that the ink is not normally supplied based on a detection result of said ink supply state.

Further, the present invention relates to a valve protection method of the liquid discharge head having the heat generating element inside the liquid flow path which communicates with the discharge port and a movable plate for directing the bubble growing on the heat generating element by the film boiling toward the side of the above-described outlet, wherein, when the temperature rise inside the above-described liquid flow path is detected and that temperature rise is more than a predetermined threshold value, a judgment is made that the ink is in a state of being not normally supplied and the driving to the above-described heat generating element is controlled or stopped.

In such a configuration of the present invention, the ink supply state of the liquid flow path where the movable member (movable valve) is arranged is estimated or detected and, if the ink supply state is not normal, the driving of the heat generating element is controlled or stopped so that it is possible to prevent the empty discharge or the empty printing of the recording head at an early stage and limit the displacement stress to the movable member to the smallest possible minimum.

Regarding the judgment method of the liquid supply failure state of the present invention, a judgment is made on the liquid supply failure by judging abnormality of the temperature rise of the liquid chamber inside the head (in the case of plurality of nozzles, referred to as common liquid chamber) for supplying the liquid to the flow path (nozzle) in which the electro-thermal conversion element is located, or employment of the flow path sensor or CR sensor as mentioned in Japanese Patent Application Laid-Open No. 10-109430 specification or temperature rise detection means to be described later and like for judging the liquid state inside the liquid supply member for maintaining the liquid for use of the liquid supply to the head and the liquid state in the supply route can be adopted, and these sensors and detection means can be utilized as an information source in terms of the prohibition or the limitation of the displacement of the movable member.

BRIEF DESCRIPTION OF THE DRAWINGS

FIG. 2A shows a plan view of the element substrate and FIG. 2B a plan view of the top plate;

BRIEF DESCRIPTION OF THE PREFERRED EMBODIMENTS

Next, the embodiments of the present invention will be described with reference to the drawings.

Head Configurational Example Adopting the Present Invention

Figure 1:
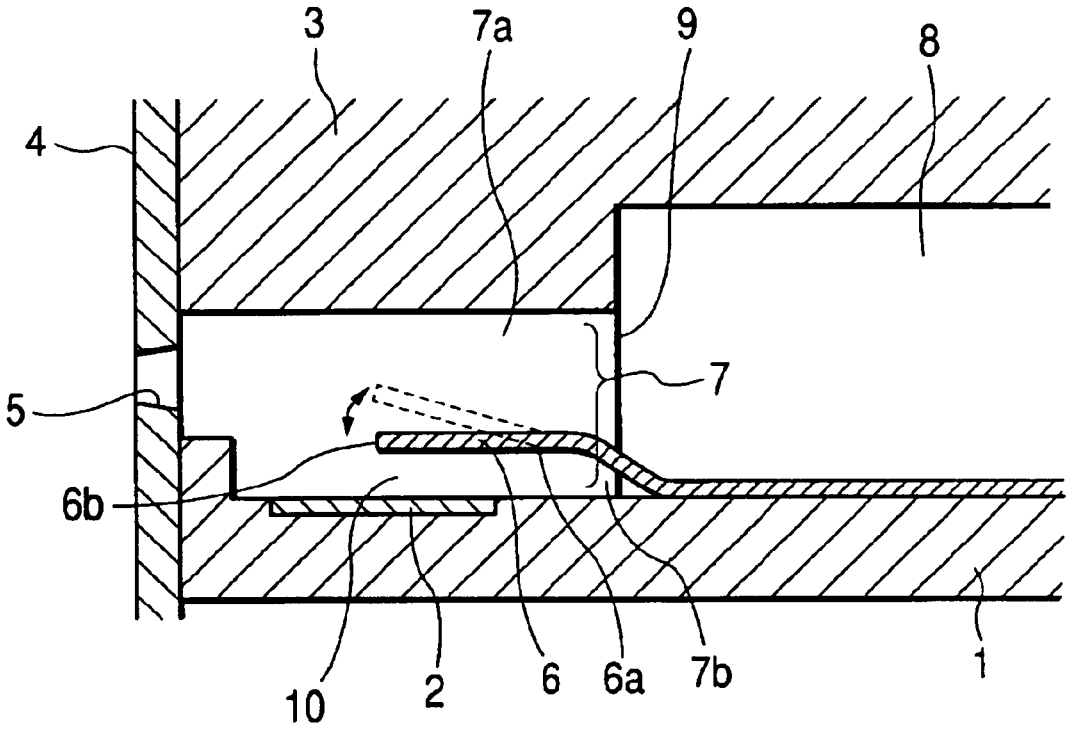
FIG. 1 is a cross-sectional view along a liquid flow path direction of an ink jet recording head, which is one embodiment of the present invention.

FIG. 1 is a cross-sectional view along a liquid flow path direction of an ink jet recording head which is one aspect of the embodiment of the present invention.

As shown in FIG. 1, the ink jet recording head (as an example of a liquid discharge head comprises an element substrate 1 in which heat generating elements 2, which are a plurality (although only one is shown in FIG. 1) of recording elements, for applying thermal energy to liquid to generate a bubble, a top plate 3 joined on this element substrate 1, an orifice plate 4 joined to the element substrate 1 and a front end surface of the top plate 3, and a movable member 6 installed inside a liquid flow path 7 which is constituted by the element substrate 1 and the top plate 3.

The element substrate 1 is a substrate where a silicon oxide film or a silicon nitride film for insulation and heat accumulation is formed on a substrate such as silicon or the like, and an electrical resistance layer and a wiring are patterned thereon. From this wiring, a voltage is applied to the electrical resistance layer and a current is let flow to the electrical resistance layer so that the heat generating element 2 is heated. On this wiring and the electrical resistance layer, a protective film for protecting them from ink is formed and, further, on that protective layer, an anti-cavitation film for protecting them from a cavitation due to an ink bubble collapse is formed.

The top plate 3 is for constituting a common liquid chamber 8 for supplying the liquid to a plurality of liquid flow paths 7 corresponding to each heat generating element 2 and each liquid flow path 7, and a flow path side wall 9 extending from a ceiling portion to each heat generating element 2 is integrally installed. The top plate 3 is constituted by a material of silicon system and forms patterns of the liquid flow path 7 and the common liquid chamber 8 by etching or, after materials such as silicon nitride, silicon oxide or the like which become the flow path side wall 9 are deposited on a silicon substrate by the known film forming method such as CVD or the like, forms a portion of the liquid flow path 7 by etching.

On the orifice plate 4, a plurality of discharge ports 5 communicating with the common liquid chamber 8 through each liquid flow path 7 are formed, in correspondence to each liquid flow path 7. The orifice plate 4 is also constituted by the material of silicon system and, for example, is formed by shaving the silicon substrate forming the discharge port 5 to a thickness of about 10–150 $\mu$m. Note that the orifice plate 4 is not necessarily required for the present invention, and, instead of installing the orifice plate 4, a wall matching the thickness of the orifice plate 4 is left on the top end surface of the top plate 3 when the liquid flow path 7 is formed in the top plate 3 and, in that portion, the discharge port 5 is formed, thereby making it the top plate provided with a discharge port.

Further, in this recording head, the movable member 6 in the shape of a cantilevered balcony is installed in the liquid flow path 7, facing the heat generating element 2. Each of the movable member 6 is in the shape of a plate having a flat surface portion opposing to the heat generating element 2, which is a thin film constituted by silicon nitride, silicon oxide or the like.

This movable member 6 has a supporting point 6*a* at the upstream side of a large flow flowing to the discharge port side 5 through the movable ember 6 from the common liquid chamber 8 by a discharge action of the liquid, and an free end 6*b* is arranged at the position facing, and spaced at a predetermined distance from, the heat generating element 2 by being placed in the vicinity of the center of the heart generating element 2 so that the movable member has the free end 6*b* at the downstream side to this supporting point 6*a*. The space between this heat generating element 2 and the movable member 6 becomes a bubble generating region 10.

Based on the above-described configuration, when the heat generating element 2 is heated, heat acts upon the liquid of the bubble generating region 10 between the movable member 6 and the heat generating element 2 and, in this way, a bubble based on a film boiling phenomenon is generated and grown on the heat generating element 2. The pressure accompanied by the growth of this bubble preferentially acts upon the movable member 6, and the movable member 6 is, as shown by a broken line in FIG. 1, displaced to the discharge port 5 with the supporting point 6*a* as a center so as to open largely. By the displacement or the displaced state of the movable member 6, propagation of the pressure based on the generation of the bubble and the growth of the bubble itself is guided to the discharge port 5 and the liquid is discharged from the discharge port 5.

That is, by installing the movable member 6 on the bubble generating region 10, which has the supporting point 6*a* at the upstream side (at the side of the common liquid chamber 8) of the flow of the liquid inside the liquid flow path 7 and the free end 6*b* at the downstream side (at the side of the discharge port 5), the pressure propagation direction of the bubble is guided to the downstream side and the pressure of the bubble directly and effectively contributes to the discharge. The growth direction itself of the bubble is also guided to the downstream direction similarly to the pressure propagation direction and the bubble grows largely in the downstream rather than the upstream direction. In this way, the growth direction itself of the bubble is controlled by the movable member, and the pressure propagation direction of the bubble is controlled so that fundamental discharge characteristics such as a discharge efficiency, discharge force, or discharge speed or the like can be improved.

On the other hand, when the bubble enters a bubble collapse process, the bubble rapidly collapses by a synergistic effect with an elastic force of the movable member 6, and the movable member 6 also finally returns to the initial position as shown by a solid line in FIG. 1. At this occasion, in order to compensate for the contraction volume of the bubble in the bubble generating region 10 and also to compensate for the volume portion of the discharged liquid, the liquid is let flow from the upstream side, that is, the common liquid chamber 8 and the filling (refill) of the liquid to the liquid flow path 7 is performed. This refill of the liquid is effectively, reasonably and stably performed accompanied by the return action of the movable member 6.

The ink jet recording head of the present embodiment drives the heat generating element 2 and comprises a circuit and an element for controlling that drive. It is preferable that these circuits and elements are assigned and arranged to the element substrate 1 or the top plate 3 according to the function so as to miniaturize the head and improve yield. These circuits and elements can be easily and minutely formed because the element substrate 1 and the top plate 3 are constituted by silicon materials.

Specifically, the recording head of the present invention is provided with a valve protection sequence for preventing damage of the movable member by the repetition of the valve action in a state where the ink is not supplied normally inside the liquid flow path 7.

Valve Protection Sequence

Regarding the valve protection sequence of the present example, an example is given in which, for example, existence and non-existence of the ink inside the nozzle is detected by using a temperature sensor, and the driving of the heater is stopped with the result of the non-existence of the ink.

Figure 2A:
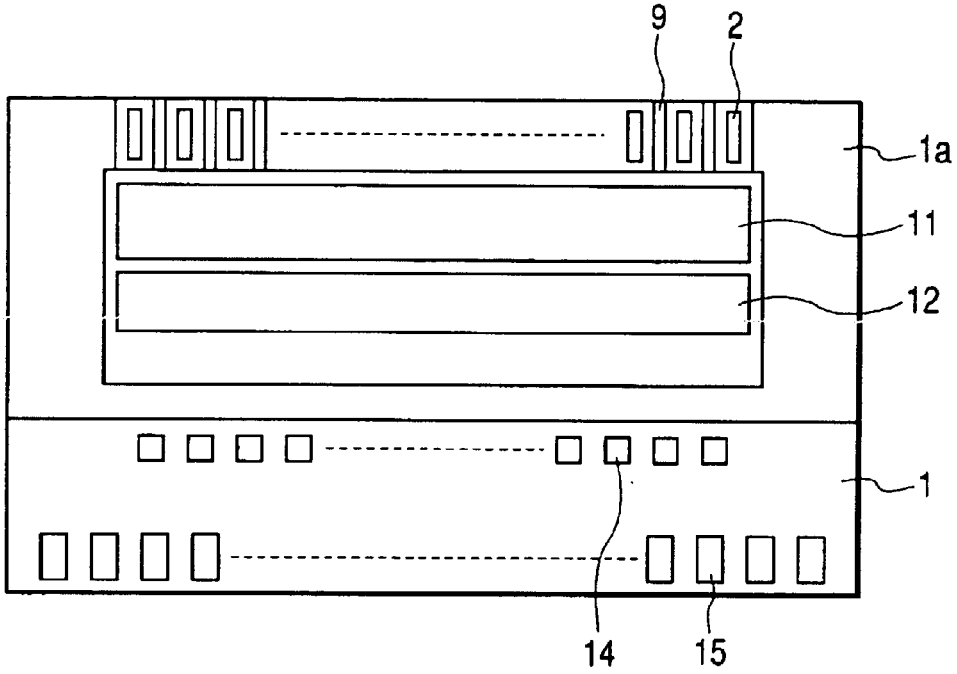
FIGS. 2A and 2B are schematic views showing valve protection circuits which are constituted by being divided into an element substrate and a top plate of the ink jet recording head of FIG. 1.
Figure 2B:
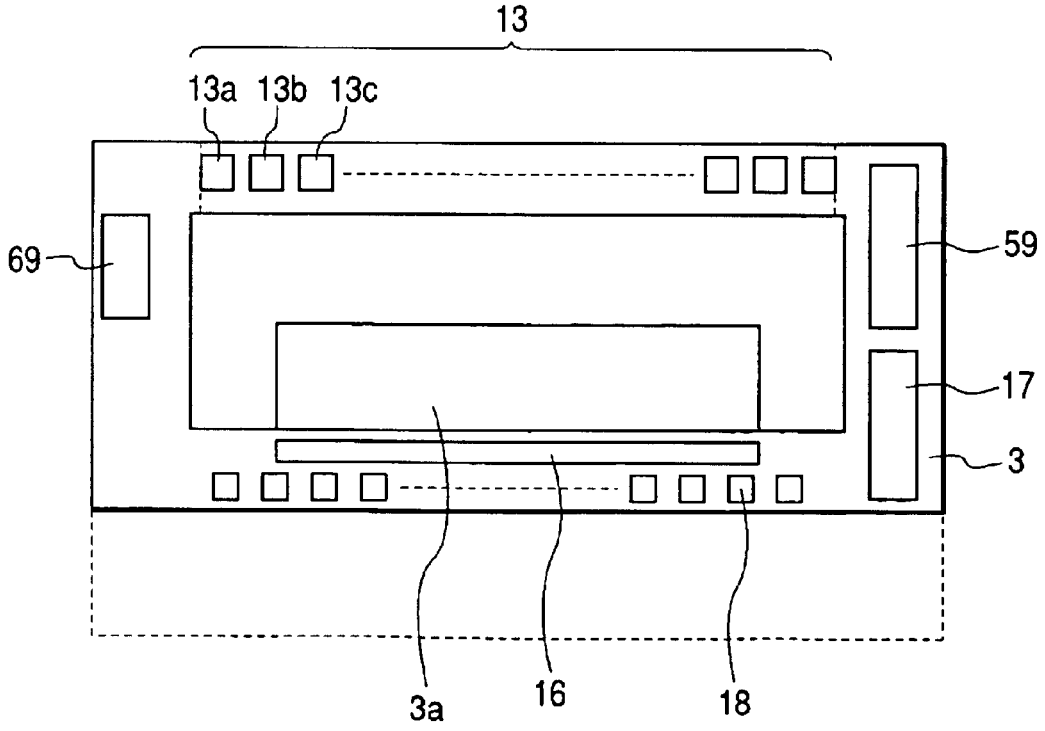

FIGS. 2A and 2B are schematic views showing circuits constituted by being assigned to the element substrate and the top plate of the ink jet recording head, and FIG. 2A shows a plan view of the element substrate and FIG. 2B a plan view of the top plate. Note that FIGS. 2A and 2B illustrate opposing faces of each other and a dot line portion in FIG. 2B shows the positions of the liquid chamber and the flow path at a time when joined with the element substrate. Although the heads as shown in FIGS. 2A and 2B show the examples in which the circuits are installed in both of the element substrate and the top plate, the circuit may be installed in either of them. However, when the yield of the head fabrication and the miniaturization of the head are considered, it is preferable that the circuits are assigned to both of the substrates. Further, although a constitution in which the flow path side wall 9 is installed in the element substrate 1 is given as an example, the flow path wall may be installed in either of the element substrate or the top plate.

In FIG. 2A, the element substrate 1 is installed with a plurality of heat generating elements 2 which are arranged in parallel by corresponding to the liquid flow paths as described above by using FIG. 1, a driver 11 for driving these heat generating elements 2 according to image data and an image data transmission portion 12 for outputting the inputted image data to the driver 11, and installed with the flow path wall 9 for forming the nozzle and a liquid chamber frame 1*a* for forming a common liquid chamber.

On the other hand, in FIG. 2B, the top plate 3 is installed with temperature sensors 13 for measuring the temperature inside the liquid flow path which are arranged so as to form a plurality of groups (in the drawing, 13*a*, 13*b*, 13*c* and so on which correspond to nozzle one by one) corresponding to different heat generating elements 2, a sensor drive portion 17 for driving the temperature sensor 13, a memory 69 for storing the temperature data inside the liquid flow path at a time when the heat generating element is driven in a normal liquid supply state, a control circuit 59 for controlling or stopping the driving of the heat generating element 2 based on the comparison result of the output of the temperature sensor 13 and the data inside the memory 69 and a heat generating element control portion 16 for controlling the drive condition of the heat generating element 2 based on the signals of the sensor drive portion 17 and the control circuit 59, and in order to supply the liquid to the common liquid chamber from outside, a supply port 3 which is communicated with the common liquid chamber is opened.

Further, on mutually opposing portions of the joined surfaces of the element substrate 1 and the top plate 3, connection contact pads 14, 18 for electrically connecting the circuit or the like which are formed by the element substrate 1 and the circuit or the like which are formed by the top plate 3 are installed. On the element substrate 1, an external contact pad 15 which becomes an input terminal of electrical signals from outside is installed. The dimension of the element substrate 1 is larger than the dimension of the top plate 3, and the external contact pad 15 is installed in a position exposed from the top plate 3 when the element substrate 1 and the top plate 3 are joined.

When the element substrate 1 and the top plate 3 constituted as above are positioned and joined, the heat generating element 2 are arranged in correspondence to respective ones of the liquid flow paths, and the circuits or the like formed on the element substrate 1 and the top plate 3 through respective connection contact pads 14, 18 are electrically connected.

The liquid flow path having a space of several tens μms is formed between the joined element substrate 1 and top plate 3 so as to be filled with the ink. However, when the driving of the heat generating element 2 is repeated without the ink being supplied to the liquid flow path, the heat of the heat generating element does not work as energy for discharge of the ink, and the temperature of the liquid flow path having no ink rises rapidly, in contrast to the normal state, where the ink is supplied.

Hence, by detecting the temperature inside the liquid flow path using the temperature sensor 13, it is possible to detect the existence and non-existence of the ink inside the liquid flow path. According to the detection result by this temperature sensor 13, for example, when the temperature sensor 13 detects an abnormal temperature rise in contrast to the time when the ink exists, the driving to the heat generating element 2 is controlled or stopped by the above-described control circuit 59 or an signal for informing an abnormality to the main body is outputted, so that physical damages of the movable member due to repetition of the empty discharge is prevented, and a head capable of always displaying a stable discharge efficiency can be provided.

Further, similarly to the present embodiment, by installing a temperature sensor in each heat generating element 2 at one-to-one correspondence, the temperature change at a time of the liquid discharge can be detected by a nozzle unit, and it is possible to detect the existence and non-existence of the ink inside the nozzle as well as a bubbling state by the temperature.

Regarding the detection of a partial empty discharge by exhaustion of the ink of each nozzle, as shown in FIG. 2B, it may be performed by the comparison of data of a plurality of adjacent nozzles (for example, among 13*a*, 13*b*, 13*c* . . . , such that when 13*b* alone starts outputting abnormally, 13*b* alone is judged to be abnormal) in addition to the comparison of the data in the case of the normal discharge stored inside the memory 69.

Furthermore, by jointly using the temperature data to be stored in order in the memory 69 and the printing data memory inside the recording apparatus, the empty discharge of the recording head may be estimated and the measure for preventing it in advance may be taken.

In the temperature data to be stored in the recording head, with a point of the time when the valve protection sequence is executed as a base point, ascending temperature data at that point of the time and a discharge ratio of the recording head (a ratio of the discharge nozzle to the number of all nozzles of the recording head per unit time, e.g., per hour) inside the printing data memory held on the recording apparatus at the same point of the time are counted and selectively stored in the memory inside the recording apparatus. In this way, before the valve protection sequence is executed, it is possible to estimate the state of the ink as not being normally supplied. Regarding a valve protection measure in this case, ink suction means of the recording head provided for the recording apparatus is used, and at a point of the time when the empty discharge is estimated, the ink suction is forced to be executed, thereby making it possible to prevent a dangerous factor (bubble) in advance, which is assumed to induce the empty discharge inside the recording head.

The data selectively stored in the memory inside the recording apparatus is selectively accumulated according to the discharge ratio of the recording head. For example, stepped memory housing regions within definite ranges having a discharge ratio of 0 to 25%, 26 to 50%, 51 to 75%, 76 to 100% of the number of all nozzles, are secured in advance, and every time the recording apparatus executes the valve protection sequence, the ascending temperature data falling within the discharge ratio of that point of the time are accumulated and compared with the ascending temperature data during the printing, thereby creating estimation means.

Figure 3:
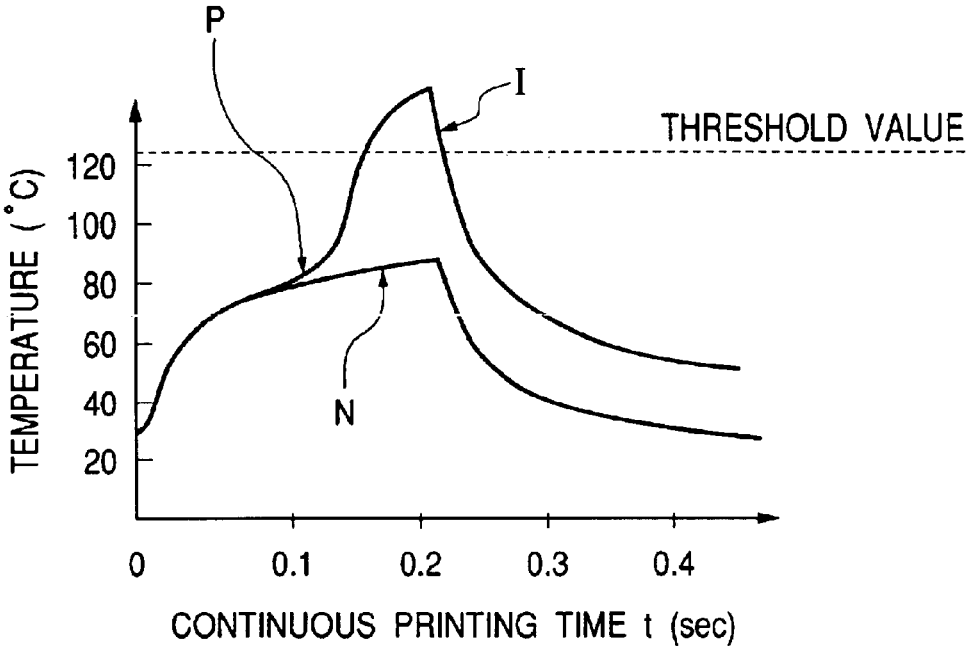
FIG. 3 is a graph showing a programmed temperature curve at a time when continuous printing drive at all nozzles is performed in a normal ink supply state and the programmed temperature curve at a time when an empty printing due to an ink supply failure in the midst of the printing is performed.
Figure 4:
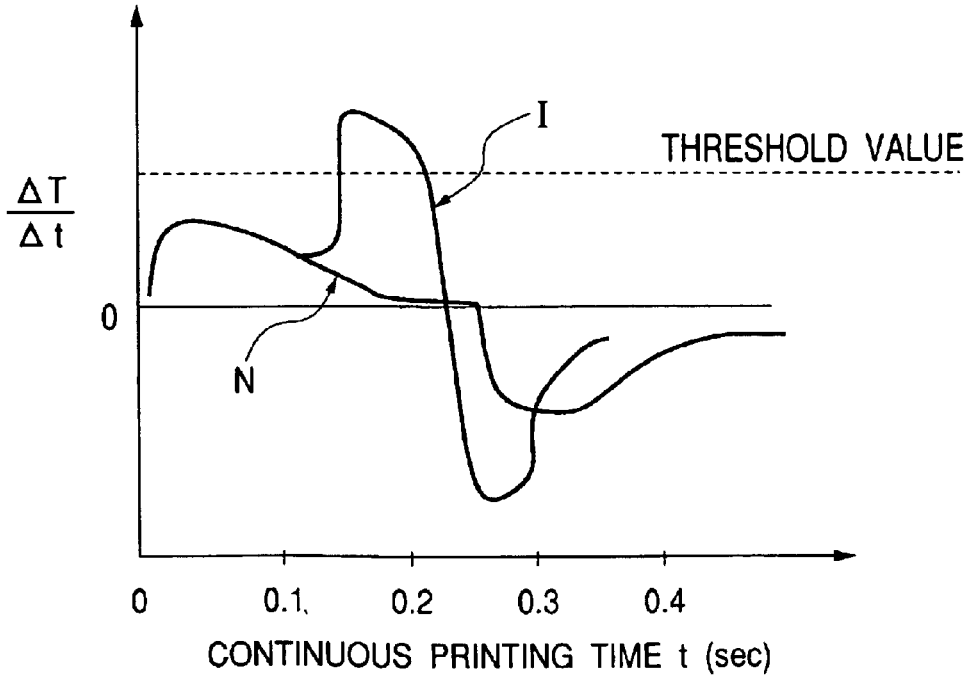
FIG. 4 is a graph in which the programmed temperature curve as shown in FIG. 3 is replaced by a programmed temperature change $\Delta T$ per unit time (hour) $\Delta t$.

Here, as an example, the ascending temperature curve at a time when a continuous printing drive at all the nozzles in a normal ink supply state is performed and the ascending temperature curve at a time when the empty printing by the ink supply defect in the midst of the printing is performed, are shown in FIG. 3. FIG. 4 is a graph in which the ascending temperature curve as shown in FIG. 3 is replaced by a temperature change ΔT per unit hour Δt, such as per hour. From these graphs, it is evident that the temperature becomes high in the case of the empty discharge state in contrast to the normal discharge time and the temperature rise ΔT per unit time is also rapid at a time of the empty discharge in contrast to the normal discharge time. By utilizing this characteristic, by judging a threshold value by the temperature change ΔT, it becomes possible to perform a highly accurate abnormal temperature detection (detection of the ink existence and non-existence) in a short time. In FIGS. 3 and 4, reference symbols P denotes a point of the discharge generation, I, an empty discharge time and N, a normal discharge time.

Figure 5:
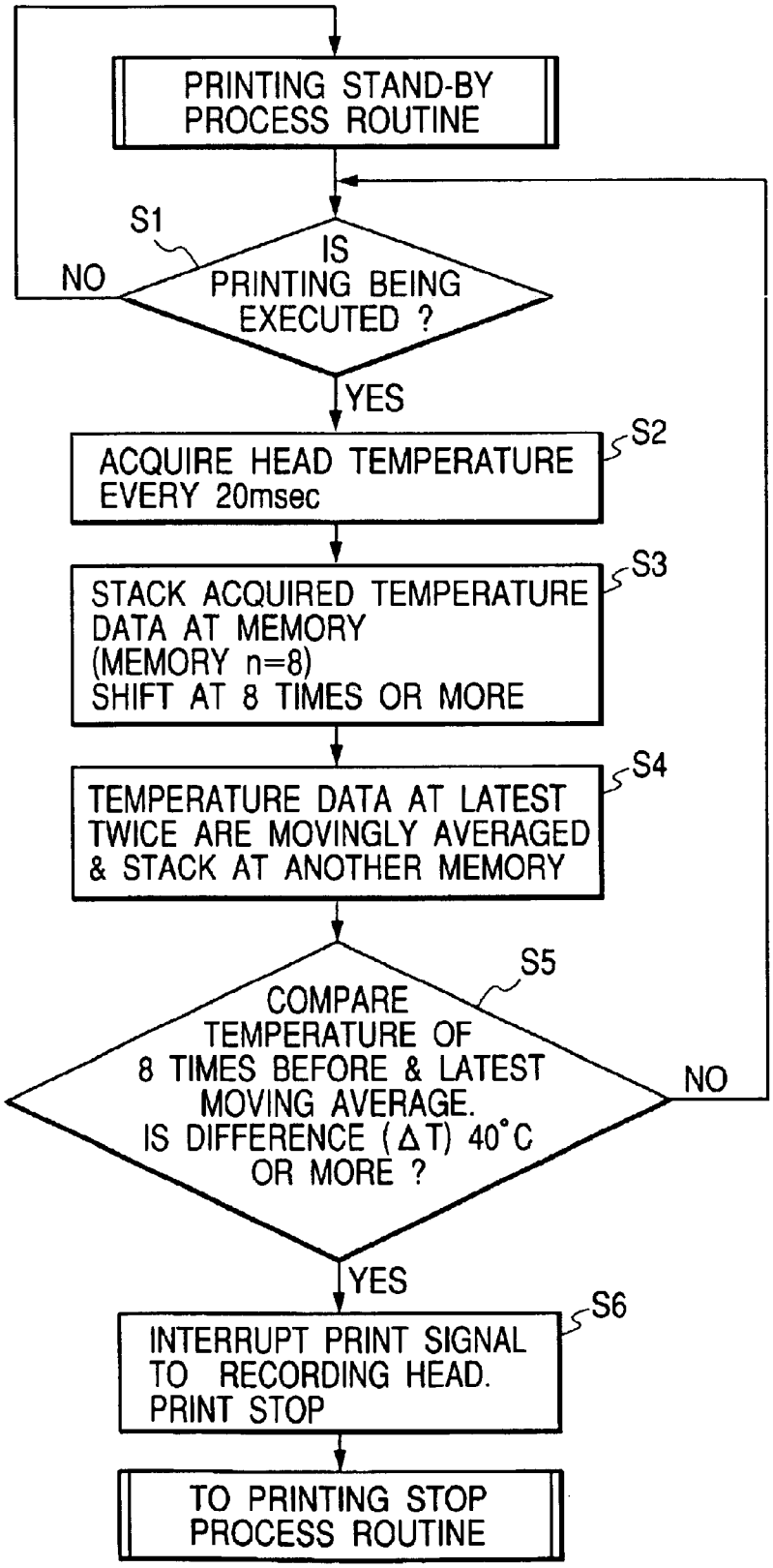
FIG. 5 is a view showing a movable valve protection sequence by a head temperature, which is adopted for the ink jet recording head of the present invention.

In FIG. 5, an example of the movable valve protection sequence by the head temperature is shown. As shown in the drawing, when the printing is being executed at step S1, the head temperature (temperature inside the flow path) is acquired for every 20 ms by the temperature sensor (step S2). The temperature data thus acquired is stored in order in the memory, but when the number of acquisitions exceeds eight, the data is removed in order of the oldest (step S3). After acquired eight times, the newest temperature data acquired two times are subjected to computation of a moving average and stored in a separate memory (step S4). Next, the temperature data acquired eight times before inside the memory and the newest moving average temperature stored in the separate memory are compared, and a judgment is made as to whether the difference (ΔT) in-between is more than 40° C. (step S5). In the step S5, when the temperature difference is found to be more than 40° C., a print signal to the recording head according to the printing data is interrupted and the printing is stopped (step S5).

In the examples as shown in FIGS. 3 to 5, the empty printing prevention at a time of the continuous discharge at all the nozzles is illustrated, but the empty printing at all the nozzles has an influence on the movable valves of all the nozzles and has an effect of preventing fatigue defect which causes deterioration of printing quality to be remarkably conspicuous. Further, because the judgment of ΔT in a short time such as 200 msec, for example, in the case where the discharge frequency of the recording head is 18 kHz and the carriage driving speed of the recording apparatus is 30 inch-sec, can detect the empty printing at a printing width of 6 inch and has an effect of preventing the empty printing at an early stage within one line in the case of a printer having an eight inch printing width of A4 paper size.

Liquid Discharge Apparatus

Next, the recording apparatus mounted with the ink jet head having the above-described valve prevention sequence to perform a recording will be described.

Figure 6:
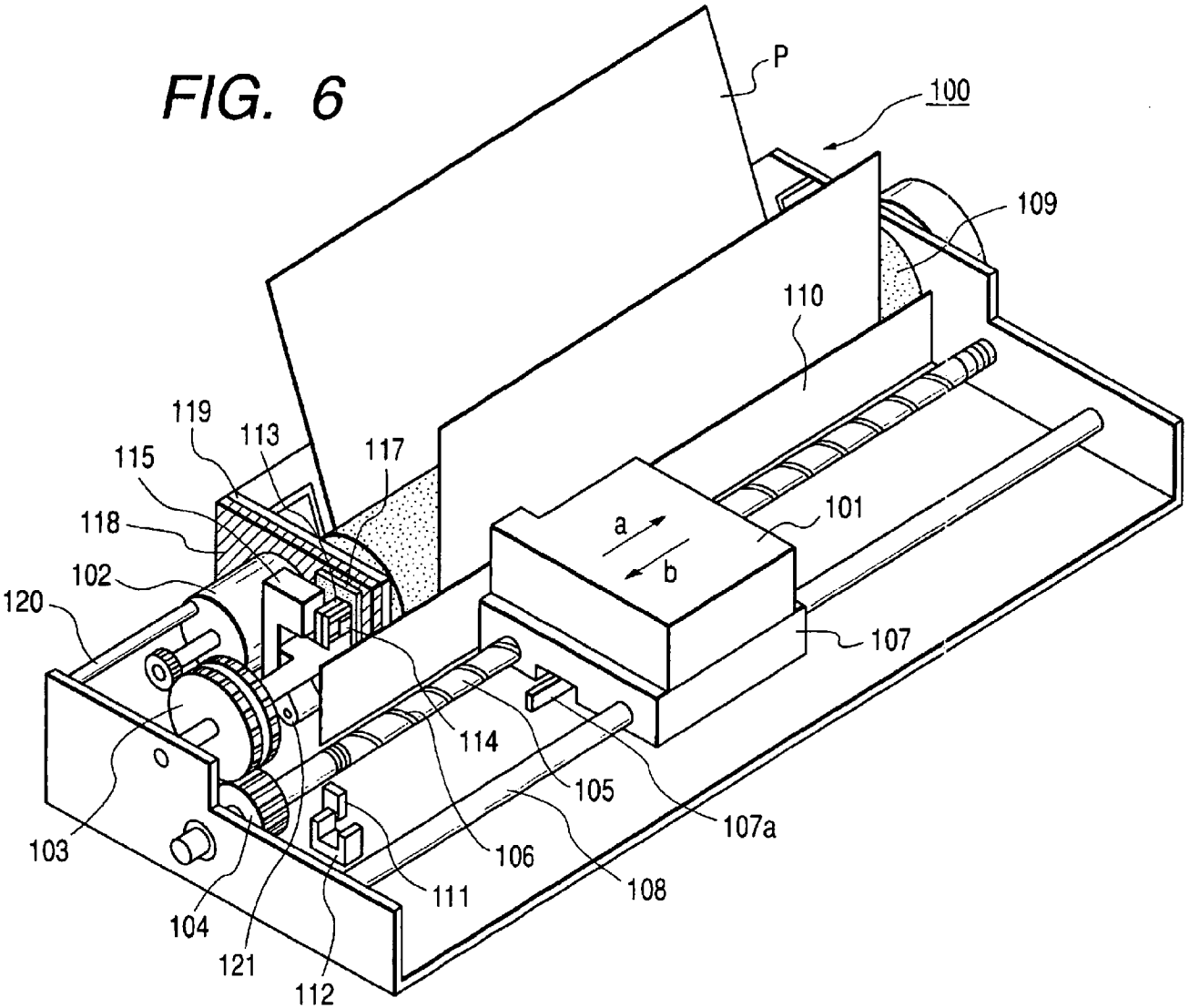
FIG. 6 is an oblique view showing a liquid discharge apparatus mounted with a liquid discharge head of the present invention.

FIG. 6 is an oblique view showing the liquid discharge apparatus mounted with the above-described ink jet head. A head cartridge 101 mounted on the ink jet recording apparatus 100 as shown in FIG. 6 comprises an ink jet head for discharging the ink for a print recording and an ink tank for holding the liquid to be supplied to the liquid discharge head.

The head cartridge 101 is, as shown in FIG. 6, mounted on a carriage 107 which engages with a spiral groove 106 of a lead screw 105 which rotates through driving force transmission gears 103 and 104 which move with the forward/reverse rotation of a driving motor 102. By motive power of the driving motor 102, the head cartridge 101 is reciprocated together with the carriage 107 in the direction of arrow marks a and b along a guide 108. The ink jet recording apparatus 100 is provided with medium to be recorded conveyance means (not shown) for conveying a printing paper P as the medium to be recorded which receives the liquid such as the ink discharged from the head cartridge 101. A paper presser plate 110 of the print paper P to be conveyed on a platen 109 by the medium to be recorded conveyance means presses the print paper P against the platen 109 across the moving direction of the carriage 107.

In the vicinity of one end of the lead screw 105, photocouplers 111 and 112 are arranged. The photocouplers 111 and 112 are home position detection means for confirming the existence of a lever 107*a* of the carriage 107 in the regions of the photo-couplers 111 and 112 and performing the switching of the rotational direction of the driving motor 102 or the like. In the vicinity of one end of the platen 109, a supporting member 113 for supporting a cap member 114 is provided, which covers a front surface having the discharge port of the head cartridge 101. In addition, the ink suction means 115 for sucking the ink which is empty-discharged from the head cartridge 101 and collected inside the cap member 114 is provided. By this ink suction means 115, suction recovery of the head cartridge 101 is performed through the opening portion of the cap member 114.

The ink jet recording apparatus 100 is provided with a main body supporting member 119. To this main body supporting member 119, a moving member 118 is movably supported backward and forward, that is, in the direction orthogonal to the moving direction of the carriage 107. The moving member 118 is attached with a cleaning blade 117. The cleaning blade 117 is not limited to this shape, but may be a known cleaning blade of other shapes. Further, on the occasion of the suction recovery operation by the ink suction means 115, a lever 120 for starting the suction is provided. The lever 120 moves with the movement of a cam 121 which engages with the carriage 107. The motive power from the driving motor 102 is movingly controlled by a known transmission means such as switching of a clutch. An ink jet recording control portion for giving a signal to the heat generating element installed in the head cartridge 101 and managing the drive control of the above-described each mechanism is installed in the recording apparatus main body side, which is not shown in FIG. 6.

In the ink jet recording apparatus 100 as described above, to the print paper P conveyed on the platen 109 by the above-described medium to be recorded conveyance means, the head cartridge 101 reciprocates across all width of the print paper P. When, on this moving time, a driving signal is supplied to the head cartridge 101 from a driving signal supply means not shown, the ink (recording liquid) is discharged from the liquid discharge portion to the medium to be recorded according to this signal and a recording is performed.

Figure 7:
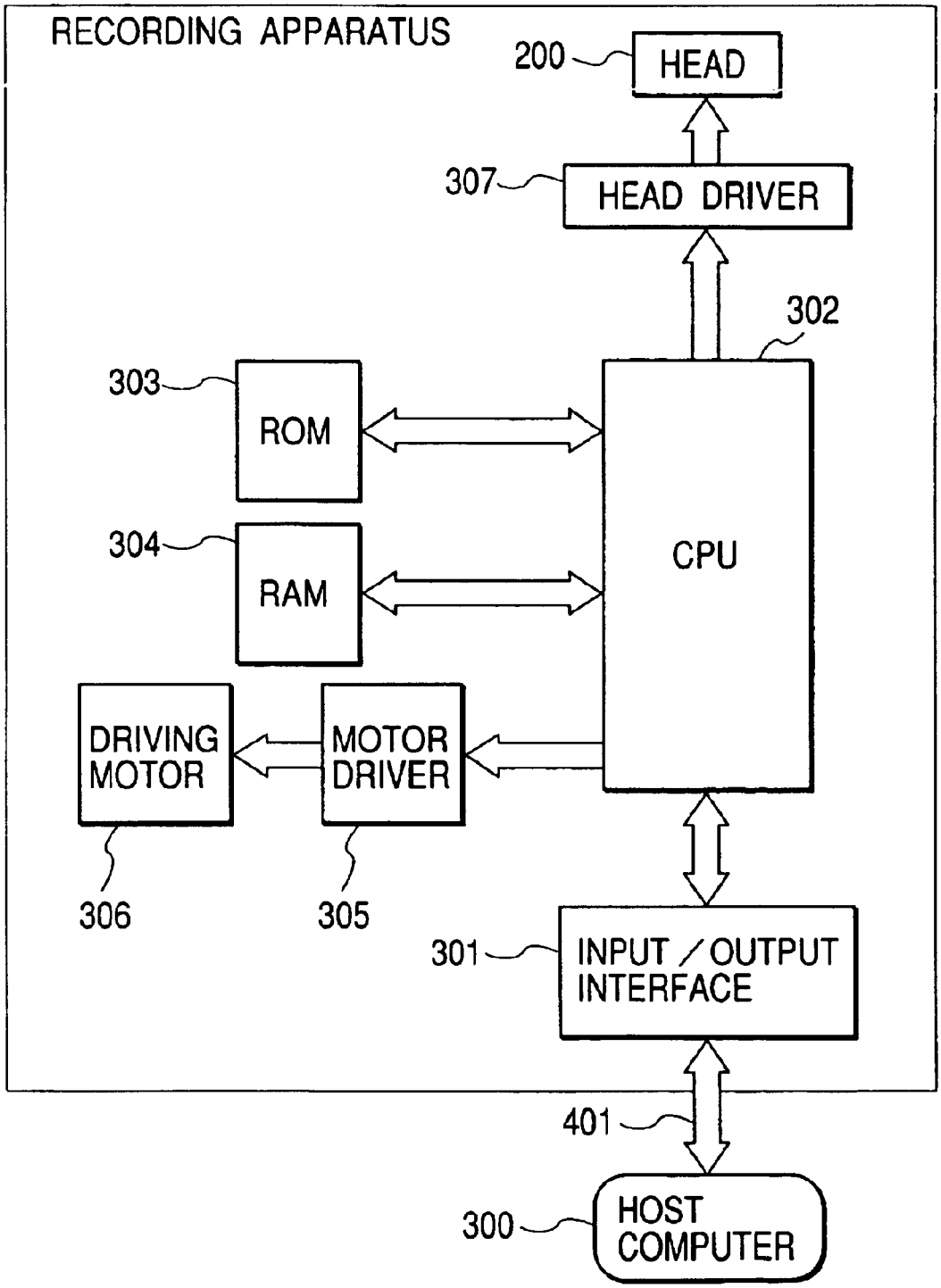
FIG. 7 is a block diagram of the whole device for activating an ink discharge recording apparatus which adopts the liquid discharge head of the present invention.
Figure 8A:
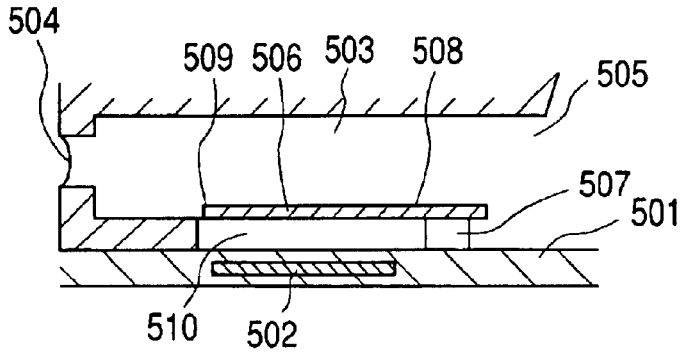
FIGS. 8A, 8B, 8C and 8D are views explaining a discharge principle in a conventional liquid discharge head.
Figure 8B:
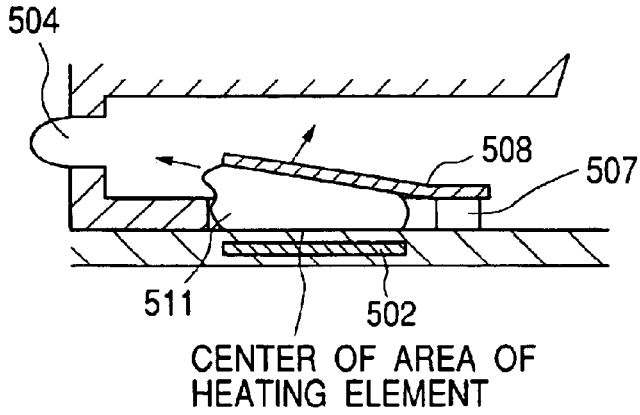
Figure 8C:
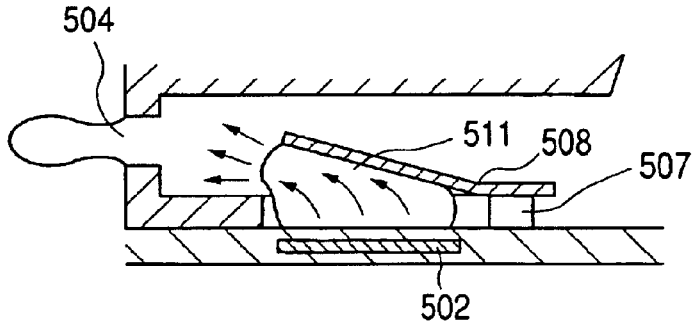
Figure 8D:
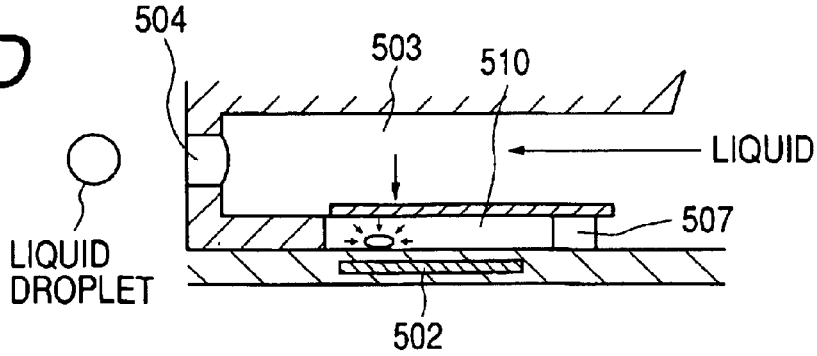
Figure 9:
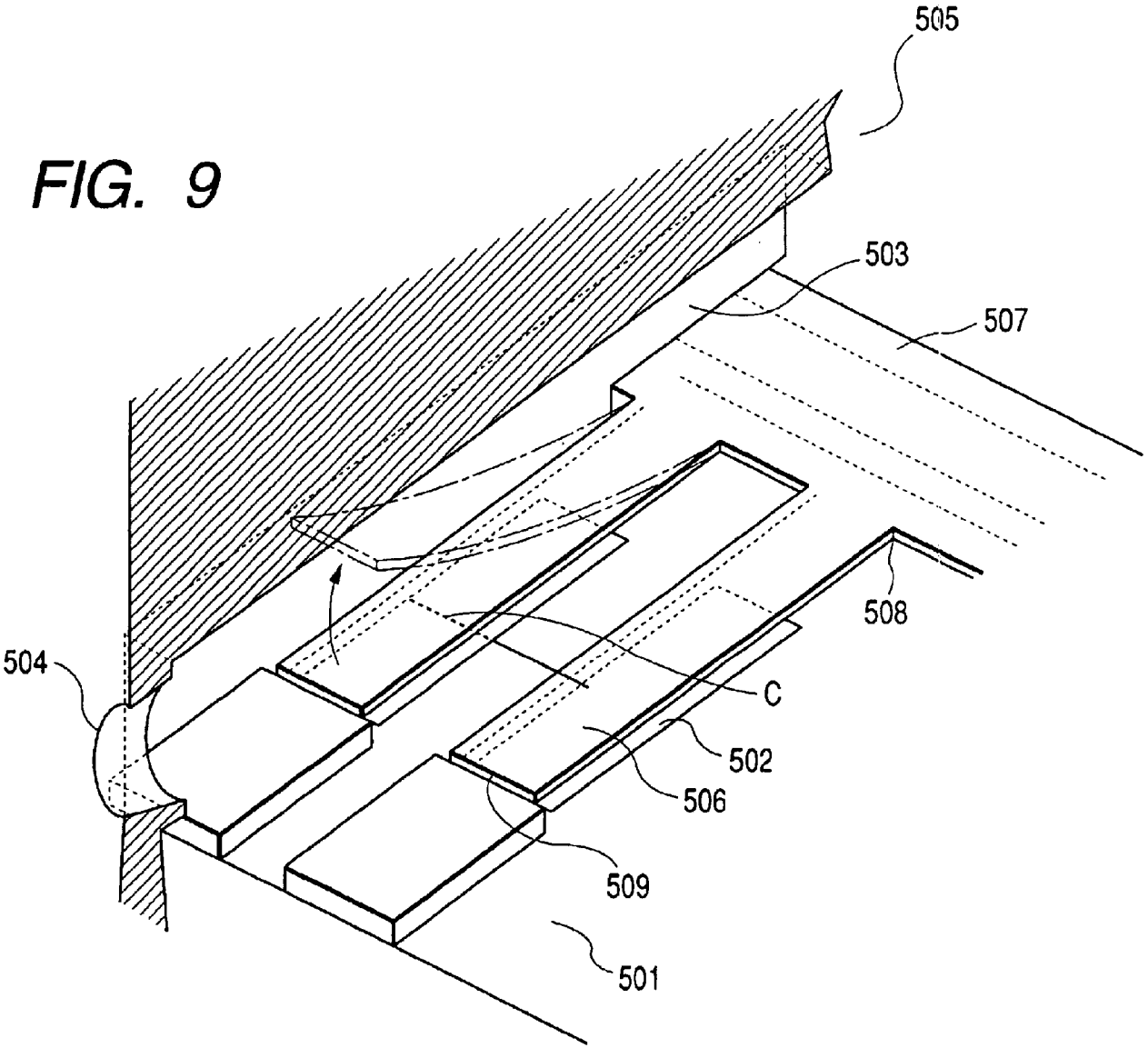
FIG. 9 is a partially broken oblique view of the liquid discharge head as shown in FIG. 8A.
Figure 10:
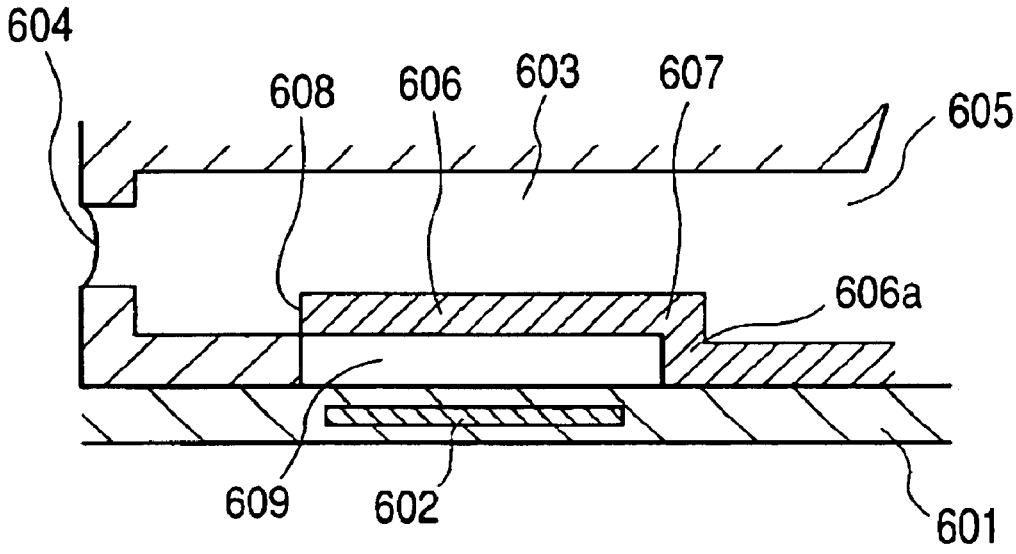
FIG. 10 is a cross-sectional view of a modified example of the liquid discharge head as shown in FIG. 8A.

FIG. 7 is a block diagram showing the entire device for operating the recording apparatus installed with the above-described inkjet head.

As shown in FIG. 7, the recording apparatus receives print information from a host computer 300 as a control signal 401. The print information is temporarily stored in an input/output interface 301 inside the recording apparatus, converted into a processable data inside the recording apparatus and inputted to a CPU302 which combines head driving signal supply means. The CPU302, based on a control program stored in a ROM 303, processes the data inputted into the CPU302 by using peripheral units such as RAM 304 and converts it into a printing data (image data).

Further, the CPU 302 prepares a driving data for driving a driving motor 306 which allows a recording paper and an ink jet head 200 to move by synchronizing with the image data in order to record the above-described image data on an adequate position on the recording paper. The image data is transmitted to the ink jet head 200 through a head driver 307 and a motor driving data is transmitted to the driving motor 306 through the motor driver 305. In this way, the ink jet head 200 and the driving motor 306 are driven respectively at a controlled timing so as to form an image.

Regarding the medium to be recorded which can be adopted for the above-described recording apparatus and to which liquid such as the ink is applied, various types of papers, OHP sheets, plastic materials used for compact disk and decoration plates, table cloths, metallic plates such as aluminum and copper, leather materials such as cowhide, pigskin, artificial leathers, trees, wood such as plywood, bamboo materials, plastic materials such as tile, three-dimensional structural members such as sponge or the like can be taken as the object.

Further, as the above-described recording apparatus, a printer apparatus for performing a recording on various types of papers and OHP sheets, a recording apparatus for use of plastics for performing a recording on plastic materials such as compact disk, a recording apparatus for use of metals for performing recording on metal plates, a recording apparatus for use of hides for performing a recording on hides, a recording apparatus for use of wood for performing a recording on wood, a recording apparatus for use of ceramics for performing a recording on ceramics, and a recording apparatus for performing a recording on three-dimensional structural members such as sponge or a textile printing apparatus for performing a recording on table cloths or the like are included.

Further, regarding the discharge liquid used for these recording apparatuses, not only the ink, but also the liquid matching respective media to be recorded on, and recording conditions, may be used.

Note that the above-described FIG. 3 provides for a temperature sensor inside each nozzle. However, in order to enhance a safety factor much more, it is preferable that the temperature sensor is installed on the substrate which is equivalent to the common liquid chamber 8 so as to judge the same temperature rise. Further, by using the sensor output or the like, a judgment of the liquid supply failure may be made on the above-described ink tank side as further upstream side supply.

It is needless to say that the above-described CPU 302 makes a judgment on a rate of rise by using the temperature information from the head, which is not illustrated in the present example. In addition, it is needless to say that the CPU 302 including the driver also may be installed in the head itself and turned into a self-closed type.

As described above, according to the liquid discharge head of the present invention, the ink supply state of the liquid flow path arranged with the movable member (movable valve) is detected and the driving of the heat generating element is controlled or stopped when the ink supply state is not normal, so that empty discharge and the empty printing of the recording head are prevented at an early stage, and the displacement stress to the movable member can be limited to the smallest possible level. As a result, high longevity and high reliability of the liquid discharge head can be secured.

What is claimed is:

1. A liquid discharge apparatus comprising:

a liquid discharge head comprising a discharge port for discharging liquid;

a liquid flow path communicating with the discharge port and having a bubble generating region for generating a bubble;

a discharge energy generating element for generating thermal energy for generating the bubble in the liquid inside the bubble generating region;

a movable member facing said discharge energy generating element and spaced apart from said discharge energy generating element, an end portion of said movable member being situated at an upstream side in the flow direction of the liquid inside said liquid flow path being fixed and a downstream end of said movable member being a free end;

a temperature sensor for periodically detecting, at a predetermined period, a temperature inside said liquid flow path;

means for controlling or stopping the driving of said discharge energy generating element by estimating that the liquid is no longer being supplied into said liquid flow path, based on data on temperature rise per period, detected by said temperature sensor and printing data; and an estimating means for estimating that liquid supply to said liquid flow path has become abnormal, by comparing the data on temperature rise per unit hour detected by said temperature sensor and data on temperature rise determined in accordance with the printing data, wherein said liquid discharge head is provided with a plurality of sets, each set including said liquid flow path, said discharge energy generating element, said movable member, and said temperature sensor, and wherein the temperature rise data determined in accordance with the printing data corresponds to a ratio of number of said liquid flow paths through which liquid is discharged from the discharge port per unit hour obtained from the printing data with respect to a total number of said liquid flow paths.

2. The liquid discharge apparatus according to claim 1, further comprising a driving signal supply means for supplying a driving signal for allowing the liquid to eject from said liquid discharge head.

3. The liquid discharge apparatus according to claim 1, further comprising a conveyance means for conveying the medium to be recorded which receives the liquid discharged from said liquid discharge head.

4. A liquid discharge apparatus according to claim 1, further comprising a first memory for storing the data on temperature rise per unit hour detected by said temperature sensor and a second memory for storing the data on temperature rise determined in accordance with the printing data.

* * * * *

UNITED STATES PATENT AND TRADEMARK OFFICE

CERTIFICATE OF CORRECTION

PATENT NO. : 6,827,416 B2 
DATED : December 7, 2004
INVENTOR(S) : Nobuyuki Matsumoto et al.

It is certified that error appears in the above-identified patent and that said Letters Patent is hereby corrected as shown below:

Column 1,
Line 15, "a" should read -- the --;
Line 18, "accompanied" should read -- in response to --;
Line 19, "by" should be deleted;
Line 26, "giving" should read -- application of --; and "allowed to" should read -- caused to undergo --;
Line 27, "produce" should be deleted;
Line 34, "discharge" should read -- discharging --;
Line 39, "a" should be deleted;
Line 42, "in" should read -- at a --;
Line 48, "even come to be used as far as" should read -- has even come to be used --;
Line 61, "high quality" should read -- a high-quality --; and
Line 63, "forgiving an" should read -- for providing a --.

Column 2,
Line 26, "liquid" should read -- of the liquid --; and
Line 29, "y" should be deleted.

Column 3,
Line 1, "an" should be deleted;
Line 58, "Each configuration" should read -- The configurations --;
Line 59, "an" should read -- a --; and
Line 66, "8 and the" should read -- 8 and --; and "as" should be deleted.

Column 4,
Line 9, "to" should read -- at --;
Line 26, "as" should read -- as a --;
Line 37, "were" should read -- was --; and
Line 46, "its" should read -- it's --.

Column 5,
Line 24, "that" should be deleted;
Line 28, "in creases" should read -- increases --;
Line 39, "the" should read -- a --;
Line 50, "defect," should read -- defect. --;
Line 53, "can" should read -- to --; and "the" should be deleted; and
Line 57, "the" should be deleted.

UNITED STATES PATENT AND TRADEMARK OFFICE

CERTIFICATE OF CORRECTION

PATENT NO. : 6,827,416 B2
DATED : December 7, 2004
INVENTOR(S) : Nobuyuki Matsumoto et al.

It is certified that error appears in the above-identified patent and that said Letters Patent is hereby corrected as shown below:

Column 6,
Line 39, "discharge" should read -- discharging --; and
Lines 49 and 60, "relates to" should read -- includes --.

Column 7,
Line 25, "and like" should be deleted.

Column 8,
Line 11, "head" should read -- head) --;
Line 30, "a" should be deleted;
Line 49, "the material of" should read -- a material of the --;
Line 62, "member" should read -- members --; and
Line 63, "to" should be deleted.

Column 9,
Line 1, "ember" should read -- member --;
Line 2, "an" should read -- a --;
Line 4, "heart" should read -- heat --;
Line 6, "to" should read -- of --;
Line 33, "to" should read -- in --; and
Line 39, "a" should be deleted.

Column 10,
Line 6, "with the result of" should read -- if the result of detection indicates --; and
Line 16, "show the" should read -- are --.

Column 11,
Line 1, "element" should read -- elements --;
Line 6, "tens" should read -- tens of --;
Line 22, "an" should read -- a --; and
Line 23, "damages of" should read -- damage to --.

Column 12,
Line 33, "at" should read -- in --; and
Line 61, "inch" should read -- inches --.

UNITED STATES PATENT AND TRADEMARK OFFICE

CERTIFICATE OF CORRECTION

PATENT NO. : 6,827,416 B2
DATED : December 7, 2004
INVENTOR(S) : Nobuyuki Matsumoto et al.

It is certified that error appears in the above-identified patent and that said Letters Patent is hereby corrected as shown below:

Column 14,
Lines 11, 37, 39, 40 and 41, "a" should be deleted;
Line 24, "disk" should read -- disks --; and
Line 35, "disk," should read -- disks, --.

Column 15,
Line 2, "and the" should read -- and --; and
Line 4, "to" should read -- on --.

Signed and Sealed this

Seventh Day of June, 2005

JON W. DUDAS
*Director of the United States Patent and Trademark Office*